US008579142B2

(12) United States Patent
Vanhove et al.

(10) Patent No.: US 8,579,142 B2
(45) Date of Patent: Nov. 12, 2013

(54) ASSEMBLY OF A CONTAINER AND A CLOSURE

(75) Inventors: Sarah Vanhove, Boutersem (BE); Daniel Peirsman, Bornem (BE); Vanessa Valles, Hasselt (BE)

(73) Assignee: Anheuser-Busch Inbev S.A., Brussels (BE)

( * ) Notice: Subject to any disclaimer, the term of this patent is extended or adjusted under 35 U.S.C. 154(b) by 164 days.

(21) Appl. No.: 12/812,879

(22) PCT Filed: Jan. 15, 2009

(86) PCT No.: PCT/EP2009/050443

§ 371 (c)(1),
(2), (4) Date: Oct. 19, 2010

(87) PCT Pub. No.: WO2009/090224

PCT Pub. Date: Jul. 23, 2009

(65) Prior Publication Data

US 2011/0024429 A1 Feb. 3, 2011

(30) Foreign Application Priority Data

Jan. 15, 2008 (EP) ..... 08100515

(51) Int. Cl.
*B67D 1/08* (2006.01)
*B65D 41/32* (2006.01)

(52) U.S. Cl.
USPC ..... 220/495.01; 220/240; 220/89.1; 220/745; 222/400.7; 222/251; 222/95; 222/105; 215/230; 215/378

(58) Field of Classification Search
USPC ..... 220/712, 713, 375, 277, 564, 717, 719, 220/729, 700, 701, 200, 254.1, 324, 90.4, 220/711, 826, 495.04, 203.01, 203.09, 220/203.13, 203.29, 500, 23.6; 215/230, 215/378, 717; 222/718, 570, 95, 105, 400.7
See application file for complete search history.

(56) References Cited

U.S. PATENT DOCUMENTS

| | | | | |
|---|---|---|---|---|
| 1,694,851 | A * | 12/1928 | Glass | 215/260 |
| 2,085,392 | A | 6/1937 | Reichel | |
| 2,467,979 | A | 4/1949 | Krueger | |
| 3,047,177 | A | 7/1962 | Poitras et al. | |
| 3,144,154 | A * | 8/1964 | Puse et al. | 215/260 |
| 3,348,728 | A * | 10/1967 | Love | 220/581 |
| 3,438,529 | A | 4/1969 | Lohrer | |

(Continued)

FOREIGN PATENT DOCUMENTS

| | | | |
|---|---|---|---|
| DE | 814258 | C | 9/1951 |
| DE | 969306 | C | 5/1958 |

(Continued)

*Primary Examiner* — Mickey Yu
*Assistant Examiner* — Gideon Weinerth
(74) *Attorney, Agent, or Firm* — Brooks Kushman P.C.

(57) ABSTRACT

An assembly of a container and a closure: the container comprising an outer shell having a neck portion defining a first access opening and a flexible inner bag having a neck finish defining second access opening; the closure being fixed to the container, said closure comprising at least two access ports positioned in front of said access openings and; the assembly comprising sealing means positioned between the closure and the container, characterized in that said sealing means comprise at least two distinct sealing members, one positioned between the closure and the neck portion, the other positioned between the closure and the neck finish.

11 Claims, 4 Drawing Sheets

(56) References Cited

U.S. PATENT DOCUMENTS

| | | | | |
|---|---|---|---|---|
| 3,450,254 | A * | 6/1969 | Miles | 206/216 |
| 3,484,011 | A * | 12/1969 | Soper et al. | 215/12.1 |
| 3,628,681 | A | 12/1971 | Schwartz | |
| 3,760,969 | A | 9/1973 | Shimamoto et al. | |
| 3,907,146 | A | 9/1975 | Fields | |
| 3,966,071 | A | 6/1976 | Northup | |
| 4,159,790 | A * | 7/1979 | Bailey | 222/211 |
| 4,330,066 | A * | 5/1982 | Berliner | 215/12.1 |
| 4,365,721 | A | 12/1982 | Montgomery | |
| 4,635,814 | A * | 1/1987 | Jones | 220/495.05 |
| 4,700,860 | A | 10/1987 | Li | |
| 4,892,230 | A * | 1/1990 | Lynn, Jr. | 222/105 |
| 4,984,713 | A * | 1/1991 | Chambers et al. | 222/105 |
| 5,031,787 | A | 7/1991 | Ochs | |
| 5,328,063 | A | 7/1994 | Beck et al. | |
| 5,435,460 | A * | 7/1995 | Osgar | 222/1 |
| 5,785,196 | A * | 7/1998 | Montgomery | 215/354 |
| 5,810,185 | A | 9/1998 | Groesbeck | |
| 5,853,096 | A * | 12/1998 | Bartur et al. | 215/261 |
| 5,904,965 | A | 5/1999 | Noel et al. | |
| 5,934,500 | A | 8/1999 | Cogger et al. | |
| 6,032,812 | A | 3/2000 | Lamoureux | |
| 6,158,604 | A | 12/2000 | Larguia, Sr. et al. | |
| 6,161,716 | A | 12/2000 | Oberhofer et al. | |
| 6,202,871 | B1 | 3/2001 | Kelly | |
| 6,220,311 | B1 * | 4/2001 | Litto | 141/67 |
| 6,230,922 | B1 * | 5/2001 | Rasche et al. | 220/586 |
| 6,679,395 | B1 | 1/2004 | Pfefferkorn et al. | |
| 6,716,396 | B1 | 4/2004 | Anderson et al. | |
| 6,848,599 | B2 * | 2/2005 | Hammarth et al. | 222/105 |
| 7,111,763 | B2 * | 9/2006 | Masuda | 222/386.5 |
| 7,314,146 | B2 * | 1/2008 | Mavin | 215/307 |
| 7,367,479 | B2 * | 5/2008 | Sitz | 222/400.7 |
| 7,819,286 | B2 * | 10/2010 | Antheil et al. | 222/105 |
| 2001/0017306 | A1 | 8/2001 | Wan et al. | |
| 2003/0089735 | A1 * | 5/2003 | Iwatsubo | 222/95 |
| 2004/0060598 | A1 * | 4/2004 | Danby et al. | 137/508 |
| 2006/0144870 | A1 * | 7/2006 | Anderson | 222/400.7 |
| 2008/0093328 | A1 | 4/2008 | Gaillot et al. | |
| 2009/0008356 | A1 * | 1/2009 | Gadzic et al. | 215/310 |
| 2009/0057347 | A1 * | 3/2009 | Leys et al. | 222/386.5 |
| 2010/0187230 | A1 * | 7/2010 | Beer et al. | 220/89.1 |
| 2011/0174760 | A1 | 7/2011 | Luzzato et al. | |

FOREIGN PATENT DOCUMENTS

| | | | |
|---|---|---|---|
| DE | 1300463 | B | 7/1969 |
| EP | 1138609 | A1 | 10/2001 |
| EP | 1245499 | A1 | 10/2002 |
| EP | 1614636 | A1 | 1/2006 |
| GB | 1074165 | | 6/1967 |
| GB | 1545293 | | 5/1979 |
| GB | 2426508 | A | 11/2006 |
| WO | 9743188 | A1 | 11/1997 |
| WO | 9807575 | A1 | 2/1998 |
| WO | 0132525 | A1 | 5/2001 |

* cited by examiner

ASSEMBLY OF A CONTAINER AND A CLOSURE

CROSS-REFERENCE TO RELATED APPLICATIONS

This application is a national phase of PCT/EP2009/050443 filed Jan. 15, 2009, which claims priority to European Application 08100515.9 filed Jan. 15, 2008, the disclosures of which are incorporated in their entirety by reference herein.

FIELD OF THE INVENTION

The present invention generally relates to an assembly of a container and a closure, the container comprising an outer shell having a neck portion defining a first access opening and a flexible inner bag having a neck finish defining second access opening, the closure being fixed to the container, thereby covering both access openings and the assembly comprising sealing means positioned between the closure and the container.

BACKGROUND OF THE INVENTION

With the increasing success of home appliance systems for carbonated beverages such as beer, there is an increasing need for safe and easy to handle containers guaranteeing an optimal storing capacity for the beverage in terms of quality maintenance and shelf life. As an answer to the mentioned needs, containers have been developed comprising an outer shell having a neck portion defining a first access opening and a flexible inner bag having a neck finish defining second access opening. Such containers are generally known as bag-in-box containers.

To adequately seal the openings while allowing access thereto for dispensing a fluid from the container, it is known to use valve assemblies that can be actuated by dispensing means provided in the home appliance systems. However valve assemblies are expensive and consist of several parts of different materials, rendering the valve assembly difficult to recycle. To overcome the above inconveniences, the home appliance systems are provided with dispensing means comprising valve assemblies, while the containers are provided with a closure comprising an access port where through the dispenser means can be introduced in the container.

WO 89/07575 discloses an assembly of a closure and a bag-in-box container, comprising two distinct sealing members, a first sealing member in the form of a sheet provided on the neck finish of the inner bag and as such sealing the access opening defined by said neck finish. A second sealing member in the form of a sheet is applied on the outer surface of the closure and covers both access ports defined therein. A drawback of this known assembly is that it can not be combined with the use of a closure having an access port that in a fixed position of the closure on the container extends into the access opening of the inner bag as in that case, the concerning sealing member would be broken.

Another drawback of a sealing member according to WO 89/07575 is that is has to be removed or pierced to gain access to the container and inner bag. This seriously limits material choice for the sealing members that need on one hand to fulfil a sealing function and on the other hand to be such that no parts can fall off during piercing of the member since such parts can fall into the liquid stored in the container.

A sealing member according WO 89/07575 has further the inconvenience in that it is difficult to apply on the neck finish of the inner bag once this is applied in the outer shell. Indeed, the access opening of the neck portion of the outer shell limits freedom to handle. This inconvenience is very pertinent when the inner bag and outer shell are assembled in a preform stage and consecutively blow moulded together. This method for manufacturing the container includes maintaining the access port of both the inner bag and the outer shell open at the time of assembling both parts, since the access openings are needed to insert air therein during blow moulding.

Given the above drawbacks and inconveniences, it is now an objective of the present invention to provide an assembly of a container and a closure comprising sealing means that allow design flexibility with regard to both the container and the closure, in particular of the access openings and access ports thereof.

It is a further objective of the present invention to provide a container of the bag-in-box type with an efficient overpressure relief system.

It is generally known that containers for storing carbonated beverages necessitate an overpressure relief system. Such an overpressure relief system has the aim to prevent uncontrolled burst of the container or an uncontrolled ejection of a valve or closure fixed thereto. Existing overpressure relief systems included containers having weakened spots in their body so as to allow a controlled burst in case of overpressure of the use of overpressure valves. With the increasing interest in home appliances, containers with weakened spots in their body have become undesirable, while valves are considered as expensive and as such also undesired. Accordingly, overpressure relief systems have been incorporated in the closure of containers.

Overpressure release systems are described in the art. For example EP-A-1 614 636 and U.S. Pat. No. 5,328,063 both disclose a closure comprising a mount piece that is snap fitted on a container and defining an outflow opening thereof. Centrally in the outflow opening is provided a stem that is an integral part of the mount piece. The closure further comprises a closure cap fixed to the mount piece, the closure cap comprising a flexible diaphragm sealing an outlet of the container and having a free edge that engages the stem. When overpressure occurs in the container, the flexible diaphragm deforms and an opening is created between the stem and the free end of the diaphragm, thereby allowing overpressure relief.

A drawback of the prior art closures incorporating an overpressure relief system is that the essentially comprise a flexible diaphragm, which clearly limits design options with respect to access control by example given piercing. Another drawback is that said closures comprise different materials, in particular a rigid portion for the fixation of the closure to the mount piece of container and a flexible portion for allowing overpressure relief. Hence, the manufacturing and recycling of the known closures is relatively complicated and expensive.

SUMMARY OF THE INVENTION

The present invention concerns an assembly of a container and a closure,

- the container comprising an outer shelf having a neck portion defining first access opening and a flexible inner bag having a neck finish defining second access opening;
- the closure being fixed to the container, said closure comprising at least two access ports positioned in front of said access openings and;

the assembly comprising sealing means positioned between the closure and the container, wherein said sealing means comprise at least two distinct sealing members, one positioned between the closure and the neck portion, the other positioned between the closure and the neck finish.

Preferably, the assembly comprises an overpressure relief system. According to a preferred embodiment, the overpressure relief system comprises a fixation between the closure and the container, the fixation comprising two fixation positions in between which the closure is movable, a first fixation position wherein the closure seals the opening of the container and a second fixation position wherein the sealing between the closure and the container is disrupted, thereby allowing pressure relief.

BRIEF DESCRIPTION OF THE DRAWINGS

In order to better explain the characteristics of the invention, the following preferred embodiments of an assembly according to the invention is given as an example only without being limitative in any way, with reference to the accompanying drawings, in which.

DETAILED DESCRIPTION OF EMBODIMENT(S)

Figure 1:
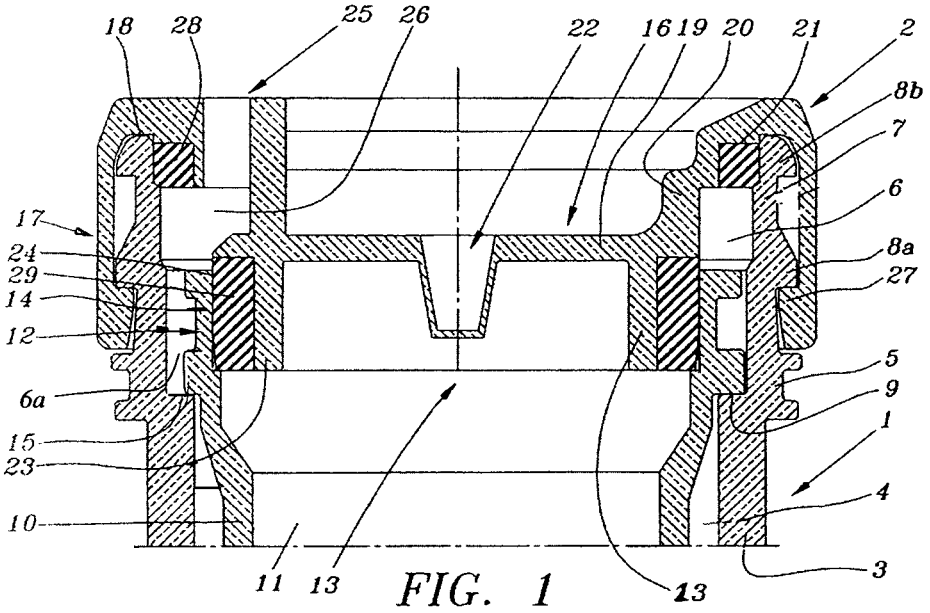
FIG. 1 represents a cross section of an assembly according the present invention.

FIG. 1 represents an assembly according to the present invention, the assembly comprising a container 1 and a closure 2 fixed thereon.

The container 1 comprises an outer shell 3 defining a space 4 and provided with a neck portion 5 defining an access opening 6. In the represented embodiment, the neck portion 5 comprises a cylindrical wall part 7 whereon are provided at least two sets 8*a* and 8*b* of outwardly extending protrusions, both sets being provided at a different level of the neck portion 5.

The neck portion 5 of the outer shell 3 further comprises a shoulder portion 9 creating a seat at the inner edge of the neck portion 5.

The different protrusions of a single set 8*a* or 8*b* are preferably positioned in an annular configuration and on a same level of the neck portion 5 and can be mutually spaced apart or can form a continuous annular rim.

In the space 4 defined by the outer shell 3 is provided an inner bag 10 manufactured in a flexible material. This inner bag 10 encloses an inner space 11 and is provided with a neck finish 12 defining an access opening 13. At its neck finish 12, the material thickness of the inner bag 10 is substantially thicker than over the rest thereof, making the neck finish 12 substantially rigid. The neck finish 12 essentially comprises a cylindrical wall part 14 provided with an outwardly extending rim 15 resting on the above mentioned seat 9 provided in the neck portion 5 of the outer shell 3.

Figure 3:
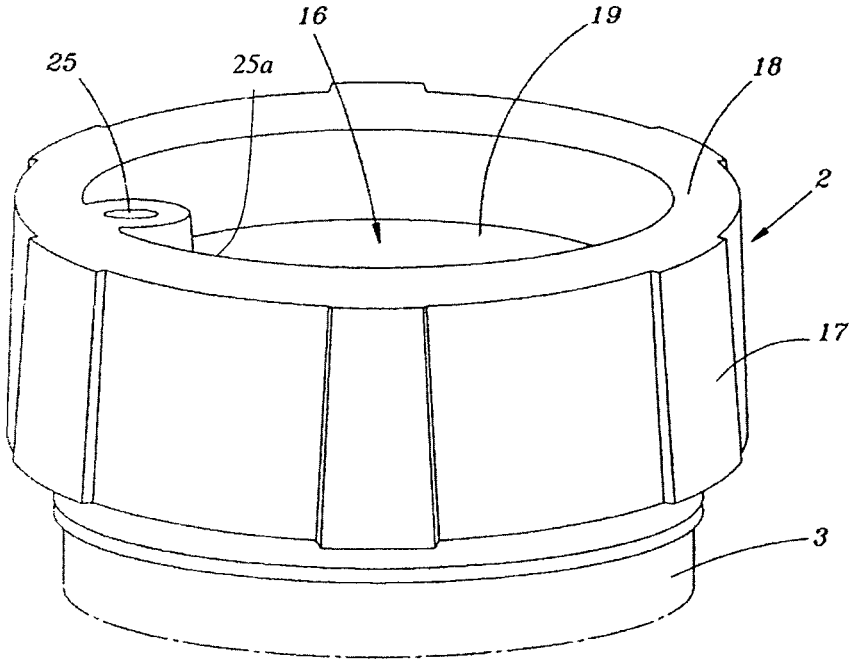
FIG. 3 represents a perspective view of a closure according the present invention.

As represented in FIG. 3, the closure 2 comprises a base 16 and a skirt 17 extending transversally with respect to the general plane of the base 16.

The base 16 is provided with a hub 18 having a peripheral edge extending into the skirt 17. The inner edge of the hub extends into a central disc 19 by a intermediate wall 20. As will be appreciated from FIG. 1, the intermediate wall 20 is provided with an outwardly directed shoulder 21 adjacent to the hub 18. The intermediate wall is preferably designed in a step-wise configuration.

The disc 19 is preferably provided with a wedged area 22 creating a piercable primary access port to the inner bag 10, while concentrically around the wedged area 22, a further cylindrical wall portion 23 is provided on said disc 19, the further wall portion 23 extending in a same sense as the skirt 17 and having a diameter that is smaller than the diameter of the disc 19, thereby creating a shoulder 24.

Along the intermediate wall 20 of the closure 2 is provided a secondary access port 25 to the space 4 intermediate the inner bag 10 and the outer shell 3. In the represented embodiment, this access port is created by a cylindrical tube 25*a* extending in a same longitudinal direction as the closure 2 up to the above mentioned disc 19. The tube 25*a* comprising an open end near the hub and a lateral opening 26 adjacent said disc 19.

Turning now to the skirt 17, it will be appreciated that it comprises a continuous cylinder, whereon a set of inwardly directed protrusions 27 is provided.

In an assembled position of the closure 2 and the container 1, the closure is fixed in a first fixation position, wherein the protrusions 27 of the closure are snap-fitted behind the protrusions 8*a* of the container 1. As clearly represented in FIG. 1, the further wall portion 23 partially extends in the access opening 13 defined by the neck finish 12, while the lateral opening 26 in the second access port 25 is situated in the access opening 6 of the outer shell, though not in the access opening 13 of the inner bag 10.

According to the invention, sealing means are provided in between the closure and the container, said sealing means at least comprising a first sealing member 28 positioned between the closure 2 and the neck portion 5 of the container. As such the first sealing member is positioned at the circumference of the access opening 6 of the outer shell 3. The sealing means further comprise a second, distinct sealing member 29 positioned between the closure 2 and the neck finish 12 of the inner bag 10. As such the second sealing member is positioned at the circumference of the access opening 13 of the inner bag 10. For the purpose of the present invention the term "distinct" should be understood that the sealing members 28-29 are acting on different, spaced apart places. In case both sealing members 28-29 are mutually connected by a connecting part having no sealing functionality the mutually connected sealing members 28-29 should be considered as distinct sealing members.

The first sealing member 28 is essentially a sealing ring made of a resilient, preferably elastomeric like material and positioned in the shoulder 21 provided at the intermediate wall 20 of the closure 2. As represented in FIG. 1, this sealing member 28 engages both said shoulder 21 and the inner edge of the neck portion 5 of the outer shell 3, thereby sealing the space 4 in the outer shell 3 from the atmosphere (apart from the second access port 25).

The second sealing member 29 is essentially cylindrical with open ends and is interposed between the shoulder portion 24 and the inside of the neck finish 12 of the inner bag 10, thereby segregating the space 4 in the outer shell 3 from the space 11 in the inner bag 10. This segregation of both spaces 4 and 11 allows both preventing fluids stored in the inner bag to leak into the space 4 in the outer shell 3, it also allows preventing fluid, in particular 02, from entering into the inner bag 10. The second sealing member 29 is preferably manufactured in a same material as the first sealing member 28, though can also be manufactured in a different resilient and preferably elastomeric like material.

Figure 2:
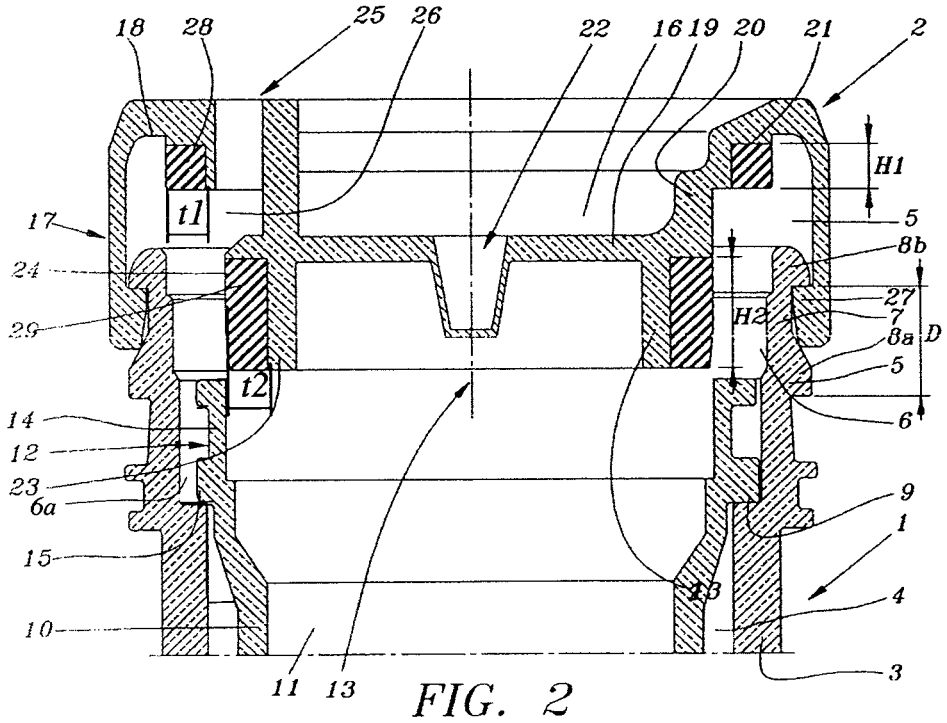
FIG. 2 represents a corresponding cross section of the assembly as FIG. 1, though in another fixation position of the closure on the container.

In a preferred embodiment and as represented in FIGS. 1 and 2, the first sealing member 28 is provided between the intermediate wall 20 of the closure 2 and the radial inner surface of the neck portion 5 of the container 1, while the second sealing member 29 is provided in between the radial outer surface of wall portion 23 of the closure 2 and the inner radial surface of neck finish 12 of the inner bag 10.

Preferably the height H1 and H2 of the sealing members 28 and 29 is smaller than the distance D between both sets of protrusions 8*a* and 8*b* provided on the neck portion 5 of the outer shell 3. It is noticed however, that the second sealing member 29 preferably has a substantial height H2. Furthermore, preferably at least the second sealing member 29 and even more preferably both sealing members 28-29 have a given thickness (t1, t2). This thickness is especially preferred when the closure 2 is manufactured in a material having a greater thermal expansion coefficient than the thermal expansion coefficient of the inner bags neck finish 12. As such, upon temperature increase, the closure will more closely fit in the neck portion of the container 1, thereby compressing the second sealing member 29 between the closure and the radial inner surface of the neck finish 12 and ensuring good sealing against fluid leakage out of the inner bag 10. The thickness of the second sealing member 29 is hereby important to provide compression capability, since otherwise, the thermal expansion of the closure will act directly on the neck finish of the inner bag 10 and the neck portion 5 of the container 1, and may cause damage. The thermal expansion coefficient is hereby defined as the relation between a change in temperature to a change in a material's linear dimensions. It is the fractional change in length per degree of temperature change. Furthermore, the thickness and/or height of the sealing members 28-29 allows good resistance against fluid permeation therethrough.

It is apparent that with the assembly according the invention, the sealing means do not form part of the access ports 22 and 25 and do not need to be pierced to gain access to the space 4 in the outer shell 3 or to the space 11 in the inner bag 10. In the case the closure 2 is positioned as represented in FIG. 1, i.e. in the fixation position the sealing means essentially provide only a sealing function and do not act as access ports.

In a preferred embodiment, both sealing members 28 and 29 are fixed to the closure 2, thereby facilitating the assembly of the closure 2 on the container 1, while assuring that the sealing members 28 and 29 are positioned correctly. The fixation can be achieved by gluing, overmoulding or any other known fixation technique assuring good contact between the sealing members and the closure.

However, it is also possible to fix the sealing members on the container or to use loose sealing members.

Overpressure Relief System

According to the invention the assembly of container 1 and closure 2 comprises an overpressure relief system comprising a fixation between the closure 2 and the container 1, said fixation comprising two positions in between which the closure 2 is movable.

In the represented embodiment, the overpressure relief system comprises both sets of protrusions 8*a* and 8*b* of the neck portion 5 as well as the skirt 17 and the corresponding set of protrusions 27.

In the above configuration of the assembly according to the invention, the first fixation position is the one wherein the set of protrusions 27 located on the skirt 17 are snap fitted (i.e. clamped) behind the set of protrusions 8*a* located closest to the containers body and wherein the closure 2 seals said opening 6 of the outer shell 3 and the opening 13 of the inner bag 10.

A second fixation position is represented in FIG. 2 and is defined as the position wherein the set of protrusions 27 of the skirt 17 are snap fitted behind the set of protrusions 8*b* located distant from the containers body. In this second fixation position, the sealing of the openings 6 and 13 is disrupted. The disruption of the sealing is assured by designing the sealing members 28 and 29 such that their height H1 and H2 is smaller than the distance D where over the closure 2 is moved by altering its fixation position. Clearly, disrupting the sealing of the space in the inner bag 10 in view of the atmosphere allows overpressure relief.

Upon positioning the closure 2 in the first (sealing) fixation position and an overpressure arises in the container, the overpressure will force the closure 2 upward into the second fixation position, wherein the overpressure is released, without the closure being loosened from the container. As such a controlled system is obtained to handle the safety issue of overpressure occurring in the container 1.

In the above described embodiment, the different protrusions can either be distinct spaced apart protrusions or can form a continuous ring.

In case the protrusions 27 form such a continuous ring and in the case the protrusion 8*b* located distant from the container 1 form a continuous rim, it is preferred that in either the ring or the rim or in both are provided some lateral grooves (not shown) that ensure contact between the space 4, 11 confined by the container and the environment when the closure 2 is positioned in the second fixation position (i.e. the position allowing overpressure relief).

Appropriate materials for both the outer shell and the closure or at least the elements constituting the overpressure relief system are stainless steel or one or more of a synthetic material such as for example polyesters and/or polyolefins.

In accordance with the above described embodiments, the neck portion 5 comprises at least two sets of protrusions 8*a* and 8*b*, while the closure is provided with at least one set of protrusions 27. In accordance with further embodiments the overpressure relief system can also comprise at least two sets of protrusions 27*a*, 27*b* on the closure 2, and at least one set of protrusions 8 on the neck portion 5, wherein during movement of the closure 2 from a first fixation position to a second fixation position, the same set of protrusions on the neck portion 5 disengages the first set of protrusions of the closure 2 and subsequently engages the second set of protrusions of said closure 2.

Apart from the above described overpressure relief system that is primarily meant as a safety measure when the pressure in the container increases to a level where burst of the container or the closure or closure blow off may occur, it is noted that the design of the closure as described in the preferred embodiment also allows gradual pressure release at lower pressure levels. Indeed, upon pressure build up, the base of the closure will slightly deform, i.e. bulge outward. The bulging results in an axial displacement of the closure 2 in a direction out of the container 1 and of a distance that is smaller than the height of the second sealing member 29 that remains engaged. As a result of the displacement of the closure 2, the head space in the container increases in volume and the pressure inside the container will slightly drop. When the pressure still further increases, the closure will bulge out some more and the second sealing member 29 will disengage from the inner surface of the neck finish 12. As such active venting is allowed. Once the pressure drops, the closure will regain its original form and the sealing member 29 will be reengaged.

The bulging of the closure and particularly the axial displacement resulting there from is, in this case, attained by the step-wise design of the intermediate wall 20 of the closure 2, allowing a displacement of the base 16 without any major displacement of the hub 18 and hence without loosening the snap fit.

Figure 4:
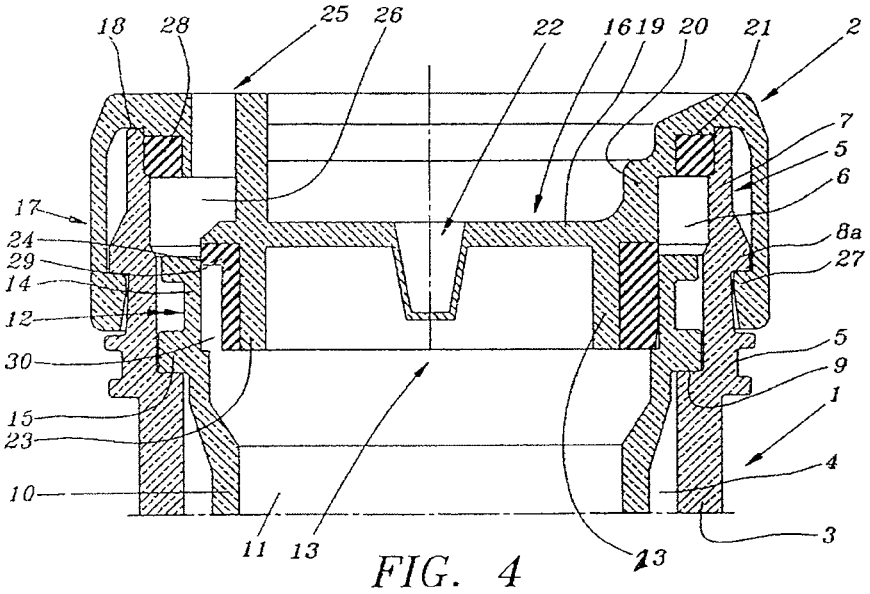
FIGS. 4 and 5 represent cross sections corresponding to FIGS. 1 and 2, in alternative embodiment mode.
Figure 5:
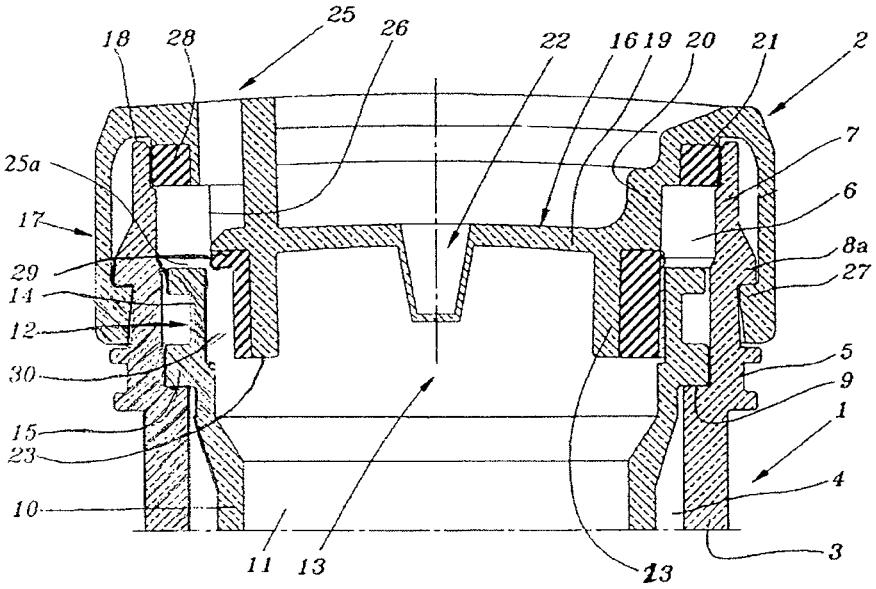
Figure 6:
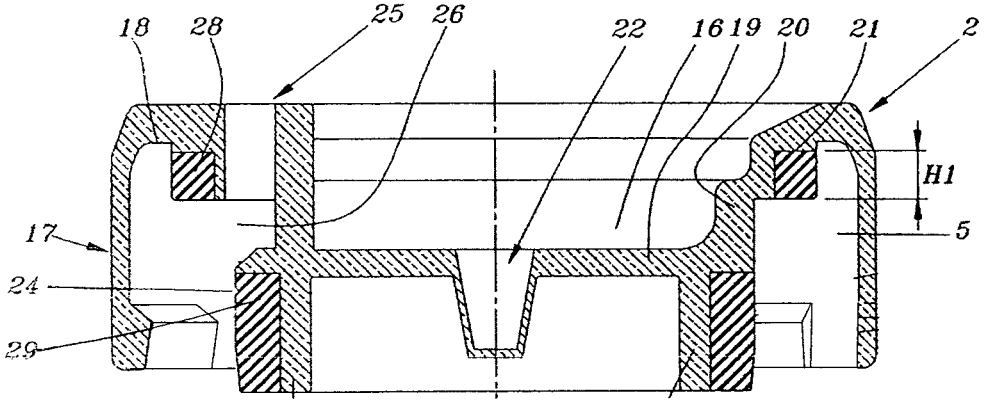
FIGS.6(*a*) and 6(*b*) show two embodiments of a closure corresponding to the assembly of FIGS. 1 and 2.
Figure 6:
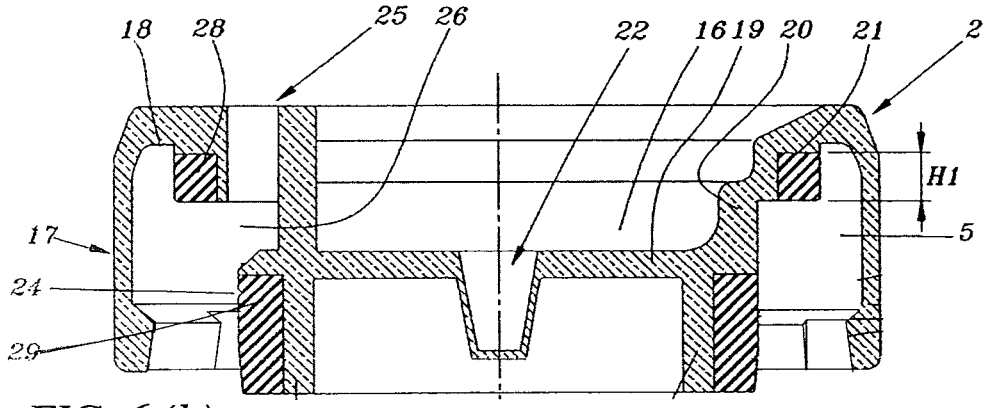
Figure 7:
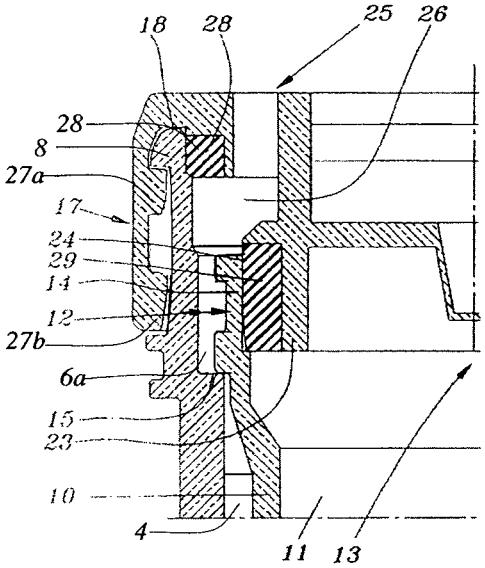
FIG. 7 shows a cross section corresponding to FIGS. 1, 2, 4, and 5, in alternative embodiment mode.

FIGS. 4 and 5 represent an alternative embodiment of an assembly according the present invention. The assembly corresponds to the assembly described with reference to FIGS. 1 to 3, apart from the fixation of the closure on to the container being achieved by just one set of outwardly extending protrusions 8*a* on the containers neck portion, thereby working in conjunction with the inwardly directed protrusions provided on the closure. Further, the base of the closure can be designed such to provide flexibility resulting into outwards bulging upon sealing a container wherein a given overpressure occurs.

From the above, it is evident that such design options can be achieved in numerous manners well-known in the practice of manufacturing.

Another alternative embodiment such as described with reference to FIGS. 4 and 5 resides in the design of the sealing member 29 positioned in between the closure 2 and the neck finish 12 of the inner bag 10. This sealing member 29 is essentially cylindrical with open ends and is provided with at least one and preferably several intrusions 30 positioned along the outer edge of the sealing. These intrusions 30 extend over a part of the height H2 of the sealing member 29 at that side of the sealing member 29 that -upon assembly, between closure and container—is directed towards the inside of the container. The part or parts of the sealing positioned in the extension of these intrusions have a height which is less than the displacement of the base of the closure during deformation caused by the overpressure in the container.

As will be appreciated from FIG. 5, the above alternative embodiment of the assembly of the invention incorporates an overpressure relief system. Indeed, in case a given overpressure arises in the container's inner bag 10, the base 16 of the closure will bulk outward, thereby displacing the second sealing member 29. Due to that displacement, the second sealing member 29 will be displaced such that the part or parts of that sealing member 29 situated in the extension of the intrusions 30 is disengaged from the inner bag's neck finish 12. As such, the intrusions 30 form venting channels between the space 11 in the inner bag and the intermediate space 4 which, in turn, is in communication with the ambient atmosphere via the second access port 25, thereby allowing overpressure relief. Alternatively, the first sealing member 28 can also be provided with an intrusion corresponding to the intrusion 30 in the second sealing member 29, such that in case of deformation of the closure 2, the first sealing member 28 too disengages.

Upon pressure drop at a given level, the closure will regain its original form and the sealing members will be reengaged and reseal the inner space 11 from the intermediate space 4 the intermediate space 4 being sealed from the ambient atmosphere.

From the above, it is evident that for the alternative embodiment, the fixation of the closure to the container is not limited to a so-called snap-fit fixation, but can also be achieved in numerous other fixation means such as, for example, by means of a thread.

The above described assemblies according the invention are particularly suited for containers designed to contain carbonated beverages, such as for example beer.

It is noted that the container according to the present invention is a container of the type generally known as bag-in-containers, also referred to as bag-in-bottles or bagin-boxes depending on the geometry of the outer vessel, all terms considered herein as being comprised within the meaning of the term bag-in-container, are a family of liquid dispensing packaging consisting of an outer container comprising an opening to the atmosphere—the mouth—and which contains a collapsible inner bag joined to said container and opening to the atmosphere at the region of said mouth. The system must comprise at least one vent 6*a* fluidly connecting the atmosphere to the region between the inner bag and the outer container in order to control the pressure in said region to squeeze the inner bag and thus dispense the liquid contained therein.

Traditionally, bag-in-containers were—and still are—produced by independently producing an inner bag provided with a specific neck closure assembly and a structural container (usually in the form of a bottle). The bag is inserted into the fully formed bottle opening and fixed thereto by means of the neck closure assembly, which comprises one opening to the interior of the bag and vents fluidly connecting the space between bag and bottle to the atmosphere; examples of such constructions can be found inter alia in U.S. Pat. Nos. 3,484,011, 3,450,254, 4,330,066, and 4,892,230.

Finally it is remarked that the present invention does not address assemblies of containers and closures comprising one or more valve assemblies provided in the access openings 6, 13 shut off by the closure 2.

The present invention is by no means limited to the embodiments described above and represented in the accompanying figures; on the contrary, such an assembly of a container and a closure comprising an overpressure relief system can be made in various executions while still remaining within the scope of the invention.

The invention claimed is:

1. A container assembly comprising:

a container comprising an outer shell having a neck portion defining a first access opening and a flexible inner bag having a neck finish defining second access opening;

a closure fixed to the container in a sealing position wherein the closure seals the first and second access openings of the container, said closure comprising at least two access ports positioned adjacent the first and second access openings respectively, the closure having distinct first and second sealing members; and wherein the closure further comprises:

a base provided with a hub having a peripheral edge extending into a skirt, an inner edge of the hub extending into a central disc by an intermediate wall provided with an outwardly directed first shoulder adjacent to the hub, and a further cylindrical wall portion extending from said disc and having a diameter that is smaller than the diameter of the disc to define a second shoulder on the disk outward of the cylindrical wall portion, and wherein, when the closure is fixed to the container in its sealing position:

the first sealing member is positioned in the first shoulder and engages both said shoulder and the inner edge of the neck portion of the outer shell, and the second sealing member is interposed between the second shoulder portion and the inside of the neck finish of the inner bag.

2. The assembly according to claim 1, wherein the assembly includes means for overpressure relief.

3. The assembly according to claim 1, wherein the closure is manufactured in a material having a greater axial thermal expansion coefficient than the axial thermal expansion coefficient of the inner bag.

4. The assembly according to claim 2 wherein the means for overpressure relief comprises a fixation between the closure and the container, the fixation comprising two fixation positions in between which the closure is movable, a first fixation position wherein the closure seals the opening of the container and a second fixation position wherein the sealing between the closure and the container is disrupted, thereby allowing pressure relief.

5. The assembly according to claim 4, wherein the sealing members are cylindrical with open ends.

6. The assembly according to claim 1, wherein each of the sealing members has a height (H1, H2) that is smaller than the distance (D) of displacement of the closure when moving from the first fixation position to the second fixation position.

7. The assembly according to claim 1, wherein the second sealing member is provided with at least one protrusion positioned along the outer edge of the sealing member and at the side thereof which, upon assembly, is directed towards the container, and extending over a part of the height of the sealing member.

8. The assembly according to claim 1, wherein the sealing members are fixed to the closure.

9. The assembly according to claim 1, wherein the neck portion of the container is provided with at least two sets of outwardly extending protrusions, both sets being provided at a different level.

10. The assembly according to claim 9, wherein the skirt comprises at least one set of inwardly directed protrusions configured to snap fit the closure behind one of the sets of protrusions on the containers neck portion.

11. The assembly according to claim 1, wherein the container is designed to contain carbonated beverages.

* * * * *